US005137240A

United States Patent [19]

Van Meter

[11] Patent Number: 5,137,240

[45] Date of Patent: Aug. 11, 1992

[54] SHOE TIE APPARATUS

[76] Inventor: Thomas A. Van Meter, 32 Howard St., McCoole, Md. 21462

[21] Appl. No.: 717,760

[22] Filed: Jun. 19, 1991

[51] Int. Cl.[5] ..... A47G 25/00

[52] U.S. Cl. ..... 248/293; 211/35; 248/240.4

[58] Field of Search ..... 248/291, 240, 240.4, 248/242, 293; 211/35

[56] References Cited

U.S. PATENT DOCUMENTS

| | | | |
|---|---|---|---|
| D. 156,537 | 12/1949 | Kent et al. . | |
| 350,031 | 9/1886 | Bacon | 248/242 |
| 547,830 | 10/1895 | Yates . | |
| 597,049 | 1/1898 | Cornell . | |
| 674,688 | 5/1901 | Stevenson | 248/240.4 |
| 749,670 | 1/1904 | Gardner | 248/240.4 |
| 824,217 | 6/1906 | Tesch . | |
| 965,816 | 7/1910 | Hill . | |
| 1,109,991 | 9/1914 | James . | |
| 1,228,042 | 5/1917 | O'Dowd | 248/240 |
| 1,232,874 | 7/1917 | Whealen | 248/240.4 X |
| 1,607,887 | 11/1926 | Fowler . | |
| 1,852,723 | 4/1932 | Orton et al. . | |
| 1,869,278 | 7/1932 | Ramelli . | |
| 1,949,017 | 2/1934 | Knupp | 211/35 |
| 2,483,758 | 10/1949 | Douglas | 248/242 |
| 2,517,183 | 8/1950 | Dunn et al. . | |
| 3,126,565 | 3/1964 | Miller | 248/240.4 X |
| 4,437,414 | 3/1984 | Brescia et al. . | |

*Primary Examiner*—David L. Talbott

*Attorney, Agent, or Firm*—David B. Newman, Jr. & Associates

[57] ABSTRACT

A collapsible shoe tie apparatus including a mounting plate, a brace and a foot plate. The mounting plate is vertically disposed for mounting to a wall. The brace is pivotally connected to the mounting plate. The foot plate is pivotally connected to the upper end of the mounting plate. The foot plate has at least one slot slidably connected to the brace. The foot plate folds against the mounting plate. In use the foot plate extends pivotally from the upper end of the mounting plate with the brace slidably extending along the slot for supporting the foot plate.

9 Claims, 2 Drawing Sheets

FIG. 1A
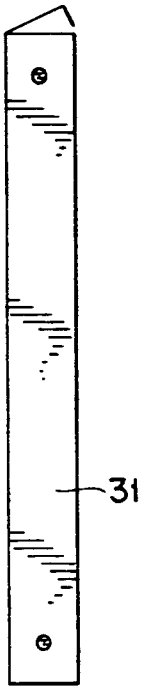
FIG. 1B
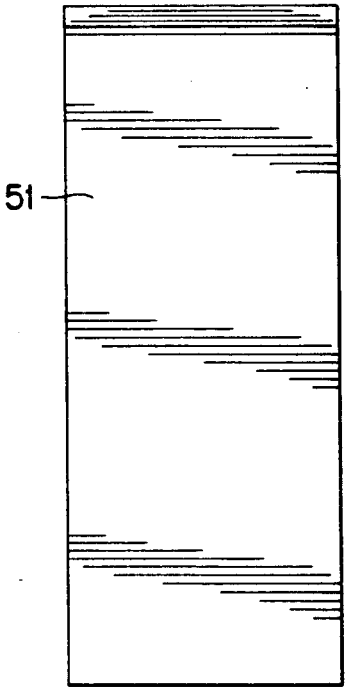
FIG. 1C
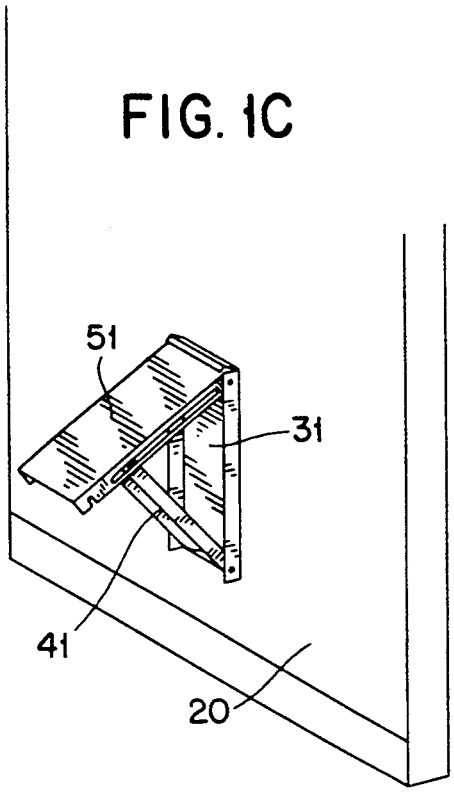
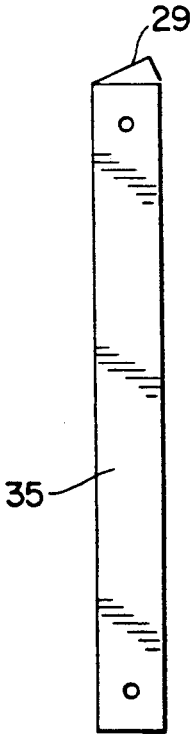
FIG. 2A
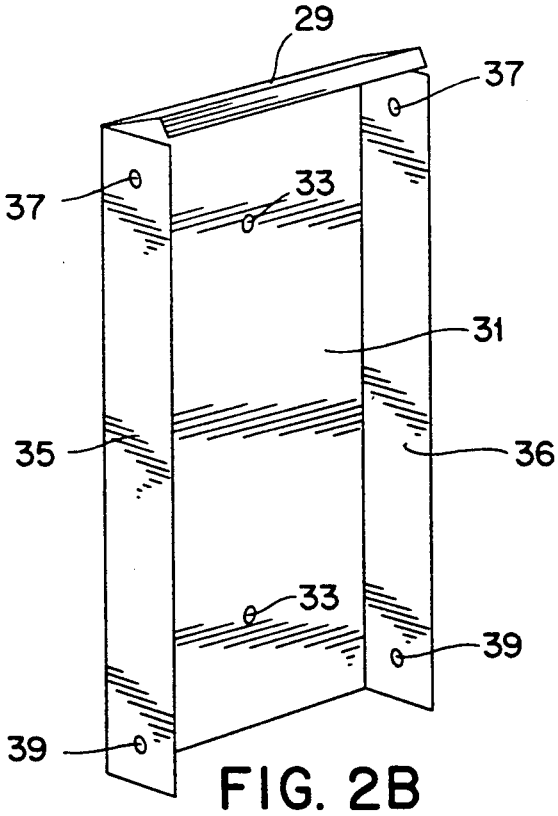
FIG. 2B

SHOE TIE APPARATUS

BACKGROUND OF THE INVENTION

This invention relates to a shoe tie apparatus and more particularly to a shoe tie apparatus for supporting an individual while tying a shoe, from a wall.

DESCRIPTION OF THE RELEVANT ART

Foot-warming attachments for heat radiators have been known in the art. They provide simple, inexpensive, and effective means for attachment to steam, hot water, or other heat radiators whereby the feet may be conveniently supported in proximity to the radiator in such manner as to enable the feet to be quickly warmed and in which the arrangement is such as to enable the device when not in use to be swung against the vertical face of the radiator. Accordingly, the foot-warming attachment is then entirely out of the way and in contact with the heating surface of the radiator, so that the heat may be imparted to the plate.

In U.S. Pat. No. 597,049 to Cornell, a foot rest is disclosed whereby the feet may be supported in proximity to the heat radiator in such a manner as to enable the feet to be quickly warmed and in which the arrangement is such as to enable the device, when not in use, to be swung against the vertical face of the radiator. U.S. Pat. No. 1,109,991 to James discloses improvements in foot rests for heat radiators which may be applied to the coil of the heat radiator and adjusted to various angles.

Supports for swing seats, shelves and other similar objects in stores have been taught by U.S. Pat. No. 824,217 to Tesh and in U.S. Pat. No. 965,816 to Hill. The fixtures of these devices are used in connection with shelves and other similar objects in stores or for supporting scaffolds upon buildings.

Aside from the teachings of warming feet and supporting shelves, the prior art does not teach an apparatus which can be used for conveniently tying shoes, and which can be swung out of the way when not in use.

OBJECTS OF THE INVENTION

An object of the invention is a shoe tie apparatus which can assist a person while tying their shoes.

Another object of the invention is a shoe tie apparatus which is easy to use and manufacture.

SUMMARY OF THE INVENTION

According to the present invention, as embodied and broadly described herein, a shoe tie apparatus is provided comprising a mounting plate, a brace plate and a foot plate. The shoe tie apparatus is used for supporting a person while tying a shoe. The collapsible shoe tie apparatus has the mounting plate vertically disposed for mounting to the wall. The mounting plate has an upper end and a lower end. The brace plate has a first end which is pivotally connected near the lower end of the mounting plate. The brace plate may include a plate having different shapes, such as a plate having the shape of a rectangle, which may be folded between the mounting pate and the foot plate. The foot plate is pivotally connected to the upper end of the mounting plate. The foot plate has at least one slot slidably connected to a second end of the brace plate. The foot plate folds against the mounting plate and the brace plate, and extends pivotally from the upper end of the mounting plate with the brace plate slidably extending along the slot for supporting the foot plate.

Additional objects and advantages of the invention will be set forth in part in the description which follows, and in part will be obvious from the description, or may be learned by practice of the invention. The objects and advantages of the invention also may be realized and attained by means of the instrumentalities and combinations particularly pointed out in the appended claims.

BRIEF DESCRIPTION OF THE DRAWINGS

The accompanying drawings, which are incorporated in and constitute a part of the specification, illustrate preferred embodiments of the invention, and together with the description serve to explain the principles of the invention.

FIGS. 1A, 1B and 1C show a side view, frontal view and oblique view of the shoe tie apparatus mounted to a wall;

FIGS. 2A and 2B show a side view and oblique view of the mounting plate;

DETAILED DESCRIPTION OF THE PREFERRED EMBODIMENTS

Figure 3A:
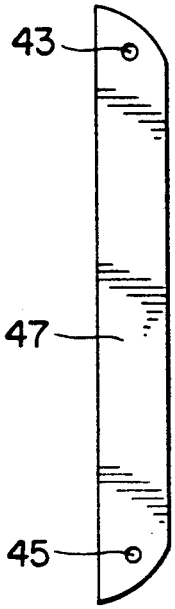
FIGS. 3A and 3B show a side view and oblique view of the brace plate.

Reference will now be made in detail to the present preferred embodiments of the invention, examples of which are illustrated in the accompanying drawings, wherein like reference numerals indicate like elements throughout the several views.

In the exemplary arrangement shown in FIGS. 1A, 1B and 1C, a shoe tie apparatus is provided comprising a mounting plate 31, a brace plate 41 and a foot plate 51. The shoe tie apparatus is shown mounted on a wall 20, for supporting a person while tying a shoe. FIGS. 1A and 1B show the shoe tie apparatus in a folded position. In FIG. 1C, the mounting plate 31 is shown vertically disposed attached to the wall 20. The brace plate 41 extends at an angle from the lower end of the mounting plate 31. The foot plate 51 is shown extended from the upper end of the mounting plate 31 and supported by the brace plate 41.

The collapsible shoe tie apparatus has the mounting plate 31 vertically disposed for mounting to the wall 30. The mounting plate 31 has an upper end and a lower end. FIG. 2A shows a side view of the mounting plate 31 which has a first side part 35. As shown in FIGS. 2A and 2B, the mounting plate has a first side part 35 which is bent outwardly, at a right angle, from the back of the mounting plate. The mounting plate 31 may include a second side part 36 which is bent outwardly, at a right angle, from the back of the mounting plate. FIG. 2B shows an oblique view of the mounting plate 31 with first side part 35 and second side part 36. In FIG. 2B the mounting plate preferably may have holes 33 wherein screws may pass through for attaching the mounting plate 31 and to a wall 20. As shown in FIGS. 2A and 2B, first side part 35 and second side part 36 each have at least an upper hole 37 which is located at the upper end of the mounting plate 31. As shown in FIG. 2B, first side part 35 and second side part 36 each have at least a lower hole 39 located at the lower end of the mounting plate 31. The mounting plate preferably may have a cover 29 which is bent outwardly from the top of the mounting plate and which overlaps the foot plate, as illustrated in FIG. 1C. The brace plate 41 has a first end which is pivotally connected near the lower end of the mounting plate 31.

Figure 3B:
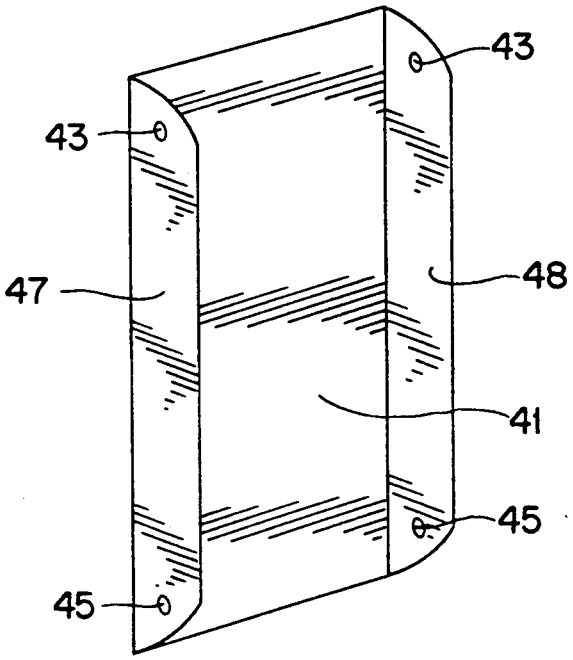

FIG. 3A shows a side view of the brace plate 41 which has a first side part 47. As shown in FIGS. 3A and 3B, the brace plate has a first side part 47 which is bent outwardly, at a right angle, from the back of the brace plate 41. As shown in FIG. 3B, the brace plate may have a second side part 48 which is bent outwardly, at a right angle, from the back of the brace plate 41. FIG. 3B shows an oblique view of the brace plate 41 with first side part 47 and second side part 48 which each have holes 43 at a first end and holes 45 at a second end. Typically, the holes 43 at the first end of the brace plate 41 are pivotally connected to the holes 39 at the lower end of the mounting plate 31. The holes may be pivotally connected using screws, rivots, or the like.

Figure 4A:
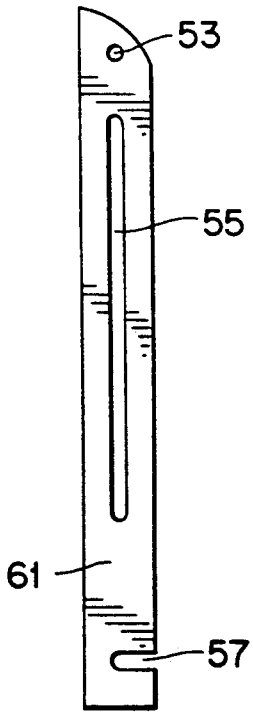
FIGS. 4A and 4B show a side view and oblique view of a foot plate.
Figure 4B:
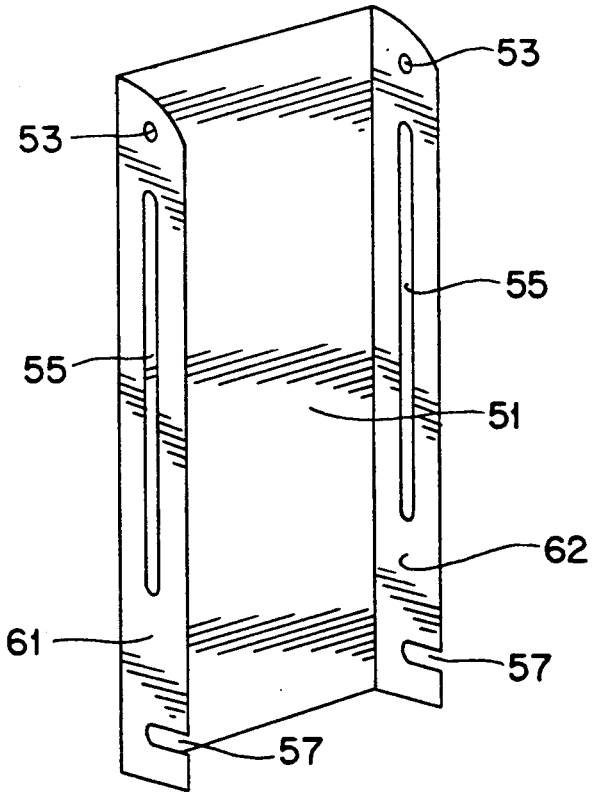

The foot plate 51 is pivotally connected to the upper end of the mounting plate 31. FIGS. 4A and 4B show a side view and oblique view of the foot plate 51. In FIG. 4A the side view shows the foot plate 51 with a first side part 61 having holes 53 at a first end, and a slot 55 along the length of the side part 61. As shown in FIGS. 4A and 4B, the foot plate has a first side part 61 which is bent inwardly, at a right angle, from the back of the foot plate 51. As shown in FIG. 4B, the foot plate may have a second side part 62 which is bent inwardly, at a right angle, from the back of the foot plate. The second side part 62 also has a slot along the length of side parts 62. At least one slot 55 is required, and two side parts 61 and 62, with each side part having slots 55, may be preferable, as illustrated in FIG. 4B, for the greater stability of the foot plate being supported by the brace plate 41 and being attached to the two side parts 47, 48 of the brace plate. A notch 57 may be included on the foot plate 51. The oblique view as shown in FIG. 4B shows the holes 53 and slot 55 of the foot plate on side parts 61, 62.

The foot plate 51 has at least one slot 55 slidably connected to a second end of the brace plate 41. Typically, the holes 45 at the second end of the brace plate 41 have rivots or screws connected thereto, for engaging slots 55 of the foot plate 51. The foot plate 51 folds against the mounting plate 31 and the brace plate 41, and extends pivotally from the upper end of the mounting plate 31 with the brace plate 41 slidably extending along the slot 55 for supporting the foot plate 51. The holes 53 of the foot plate 51 typically have screws or rivots for pivotally engaging the holes 37 of the mounting plate 31. When mounted on a wall and in use, the foot supporting plates are designed to be utilized for tying shoes. More particularly, the foot plate 51, when not in use, is folded into a vertical position parallel with the wall and contiguous to the wall mounting plate 31. To use the shoe tying apparatus from a folded position, the foot plate 51 is pulled away from the wall by grasping the end closest to the floor, and causing the bottom edge of the foot plate 51 to slide forward. This action is made possible by having the foot plate 51 pivotally connected to the wall plate 31 at an upper end of the wall plate. Additionally, the foot plate 51 is slidably engaged with a brace plate 41. The brace plate 41 supports the foot plate 51 when it is pulled out from the wall.

The action which makes the foot plate 51 slidably engaged with the brace plate 41 is due to the slots along the foot plate 51 which enables screws, rivots, or the like, threaded through the brace plate 41, to slide through the slots of the foot plate 51. This allows the screws, rivots, or the like to slide down the slots of the foot plate 51 until the foot plate 51 is at an angle from the wall.

It will be apparent to those skilled in the art that various modifications can be made to the shoe tie apparatus of the instant invention without departing from the scope or spirit of the invention, and it is intended that the present invention cover modifications and variations of the shoe tie apparatus provided they come in the scope of the appended claims and their equivalents.

I claim:

1. A collapsible shoe tie apparatus comprising:

a mounting plate vertically disposed for mounting to a wall, said mounting plate having an upper end and a lower end;

a brace plate having a first end and a second end, with said first end of said brace plate pivotally connected near the lower end of said mounting plate;

a foot plate pivotally connected near the upper end of said mounting plate, said foot plate having at least one slot slidably connected to the second end of said brace plate; and wherein said foot plate folds against said mounting plate, and extends pivotally from the upper end of said mounting plate with said brace plate slidably extending along said at least one slot for positioning said brace plate to support said foot plate.

2. The collapsible shoe tie apparatus as set forth in claim 1 further comprising:

a cover connected to the upper end of said mounting plate wherein said cover overlaps said foot plate.

3. A collapsible shoe tie apparatus comprising:

a mounting plate vertically disposed;

a brace plate pivotally connected near a lower end of said mounting plate;

a foot plate pivotally connected to said mounting plate, said foot plate having a slot slidably connected to said brace plate; and wherein said foot plate pivots at an upper end of said mounting plate with said brace plate slidably connecting along said slot for positioning said brace plate to support said foot plate.

4. The collapsible shoe tie apparatus as set forth in claim 3 wherein said foot plate has at least a second slot slidably connected to said brace plate, with said brace plate extending along said second slot for positioning said brace plate to support said foot plate.

5. The collapsible shoe tie apparatus as set forth in claim 3 further comprising:

a cover connected to the upper end of said mounting plate wherein said cover overlaps said foot plate.

6. A collapsible shoe tie apparatus comprising:

a mounting plate vertically disposed and mounted on a vertical support;

a brace plate pivotally connected near a lower end of said mounting plate;

a foot plate pivotally connected near an upper end of said mounting plate with said foot plate extending from the upper end of said mounting plate with said brace plate supporting said foot plate; and wherein said foot plate has at least one slot slidably connected to the brace plate, with said brace plate extending along said slot for positioning said brace plate to support said foot plate.

7. The collapsible shoe tie apparatus as set forth in claim 6 further comprising:

a cover connected to the upper end of said mounting plate wherein said cover overlaps said foot plate.

8. A collapsible shoe tie apparatus comprising:

a mounting plate vertically disposed for mounting to a wall, said mounting plate having an upper end, a lower end, and two side parts, with each of the two side parts of said mounting plate bending outwardly, at a right angle, from said mounting plate;

a brace plate having a first end, a second end, and two side parts, with each of the two side parts of said brace plate bending outwardly, at a right angle, from the brace plate, with the first end of said brace plate pivotally connected near the lower end of said mounting plate;

a foot plate pivotally connected near the upper end of said mounting plate, said foot plate having two side parts, with each of the two side parts of said foot plate bending inwardly, at a right angle, from the foot plate, with each of the two side parts having at least one slot slidably connected to the two side parts at the second end of said brace plate; and wherein said foot plate folds against said mounting plate, and extends pivotally from the upper end of said mounting plate with said brace plate slidably extending along each slot for positioning said brace plate to support said foot plate.

9. The collapsible shoe tie apparatus as set forth in claim 8 further comprising:

a cover connected to the upper end of said mounting plate wherein said cover overlaps said foot plate.

* * * * *